United States Patent [19]

Kaleta

[11] Patent Number: 4,624,188

[45] Date of Patent: Nov. 25, 1986

[54] STACK SUPPORTING CONTAINER CAR

[75] Inventor: Gary S. Kaleta, Warren, Oreg.

[73] Assignee: Gunderson, Inc., Portland, Oreg.

[21] Appl. No.: 640,733

[22] Filed: Aug. 14, 1984

[51] Int. Cl.[4] ..... B61D 3/20

[52] U.S. Cl. ..... 105/355; 105/4 R; 114/75; 410/52; 410/77; 410/94

[58] Field of Search ..... 105/3, 4 R, 158 A, 238 A, 105/355, 404; 410/2, 31, 32, 44, 52, 54, 56, 71, 76–78, 94; 114/72, 75

[56] References Cited

U.S. PATENT DOCUMENTS

| | | | |
|---|---|---|---|
| 2,837,037 | 6/1958 | Holmberg | 410/65 |
| 3,078,814 | 2/1963 | Candlin, Jr. et al. | 105/404 |
| 3,242,879 | 3/1966 | Bronlund | 410/45 |
| 3,339,501 | 9/1967 | Gutridge | 410/71 X |
| 3,357,371 | 12/1967 | Gutridge | 410/52 X |
| 3,396,673 | 8/1968 | Livelsberger et al. | 105/4 R |
| 3,399,631 | 9/1968 | Weber | 105/4 R |
| 3,509,829 | 5/1970 | Henriksson et al. | 410/65 |
| 3,520,256 | 7/1970 | Gutridge | 410/52 |
| 4,233,909 | 11/1980 | Adams et al. | 105/4 R |
| 4,315,465 | 2/1982 | Cordani et al. | 105/4 R |
| 4,354,781 | 10/1982 | Roberts | 410/77 |
| 4,452,147 | 6/1984 | Jwuc | 105/4 R X |
| 4,454,821 | 6/1984 | Dickhart, III | 105/4 R |
| 4,456,413 | 6/1984 | Pavlick | 410/56 |
| 4,478,155 | 10/1984 | Cena et al. | 410/44 X |

OTHER PUBLICATIONS

Youngstown Steel Door Company brochure entitled Backpacker.

Progressive Railroading publication dated Jul. 1981 entitled Low Riding, Sturdy Intermodal Car.

Southern Pacific Transportation Company brochure No. 7255-0100-6/82.

*Primary Examiner*—Randolph A. Reese

*Attorney, Agent, or Firm*—Chernoff, Vilhauer, McClung & Stenzel

[57] ABSTRACT

A stack supporting container car includes a plurality of car units interconnected by articulating connector with the end units provided with conventional railroad couplers. Each car unit includes side sills and body bolsters supported on trucks. The side sills and body bolsters are spaced apart sufficiently to allow the bottom portion of a short lower container to pass therethrough with the weight of the stack of containers being supported only by four corner feet connected to and projecting below the side sills. Bulkheads with fixed side and end container restraining walls and with movable corner engaging mechanisms are provided on the car unit to selectively restrain either a short or a long container supported upon the lower container in transport position on the car unit. The upper and lower surfaces of containers provide ample clearance to safely move over the rails and under bridges or the like.

3 Claims, 15 Drawing Figures

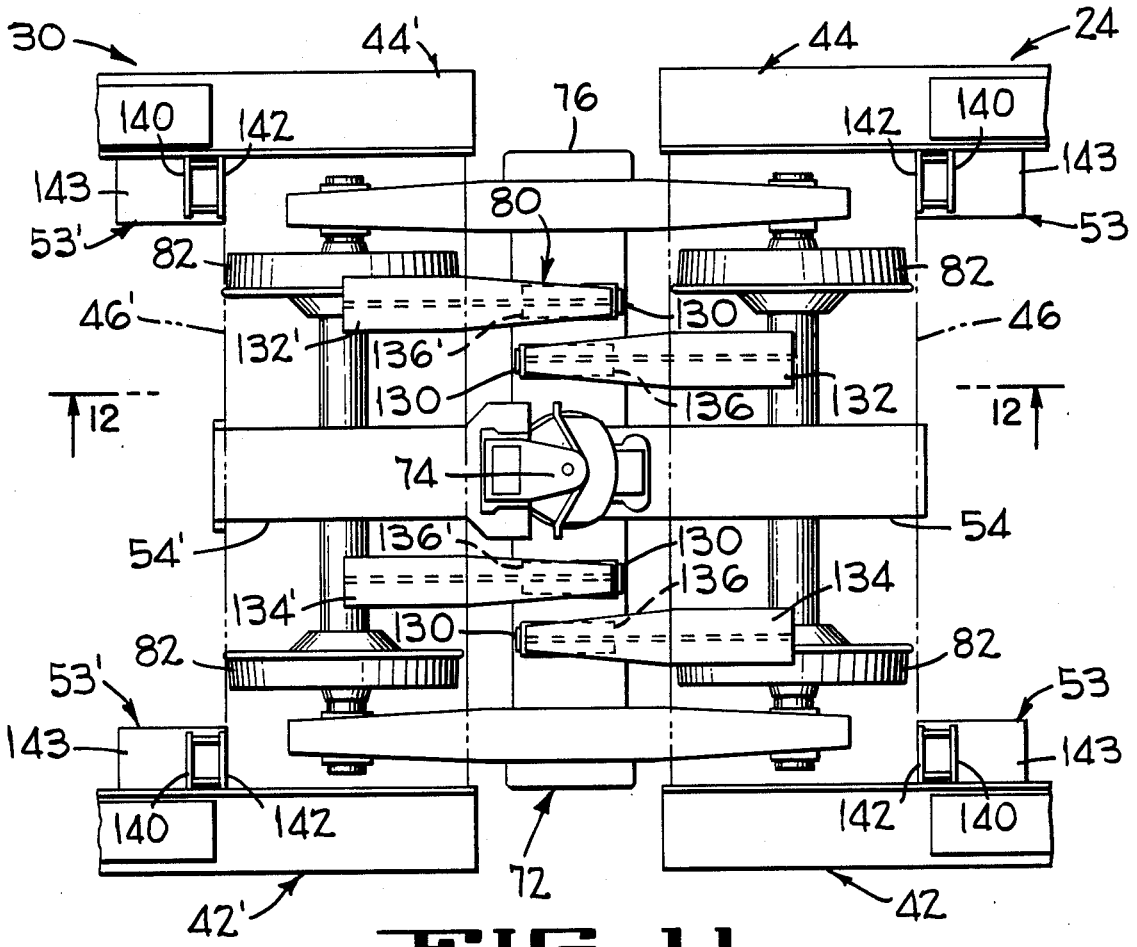
FIG_11
FIG_12
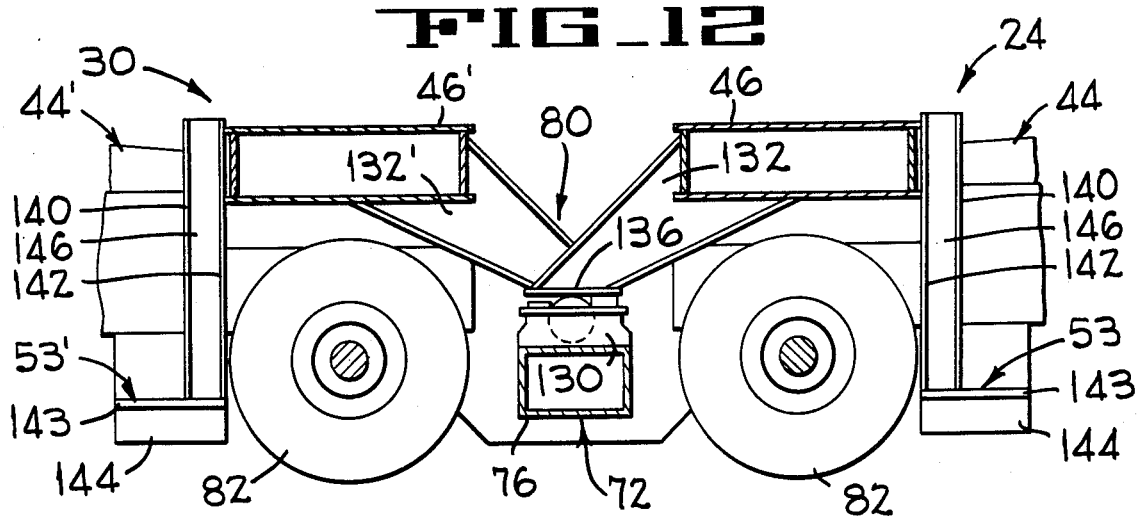

FIG_13
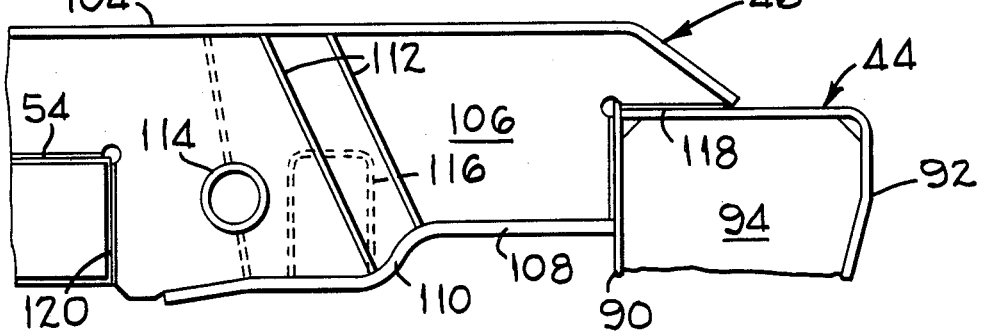
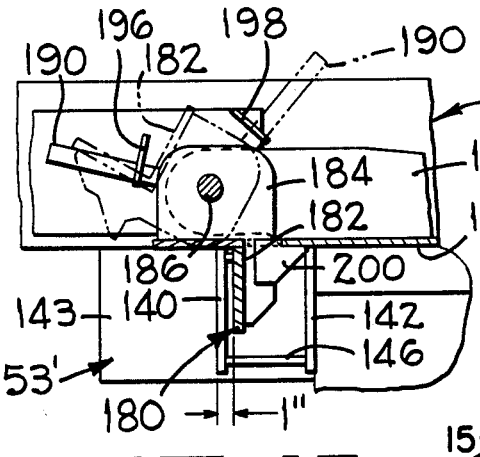
FIG_15
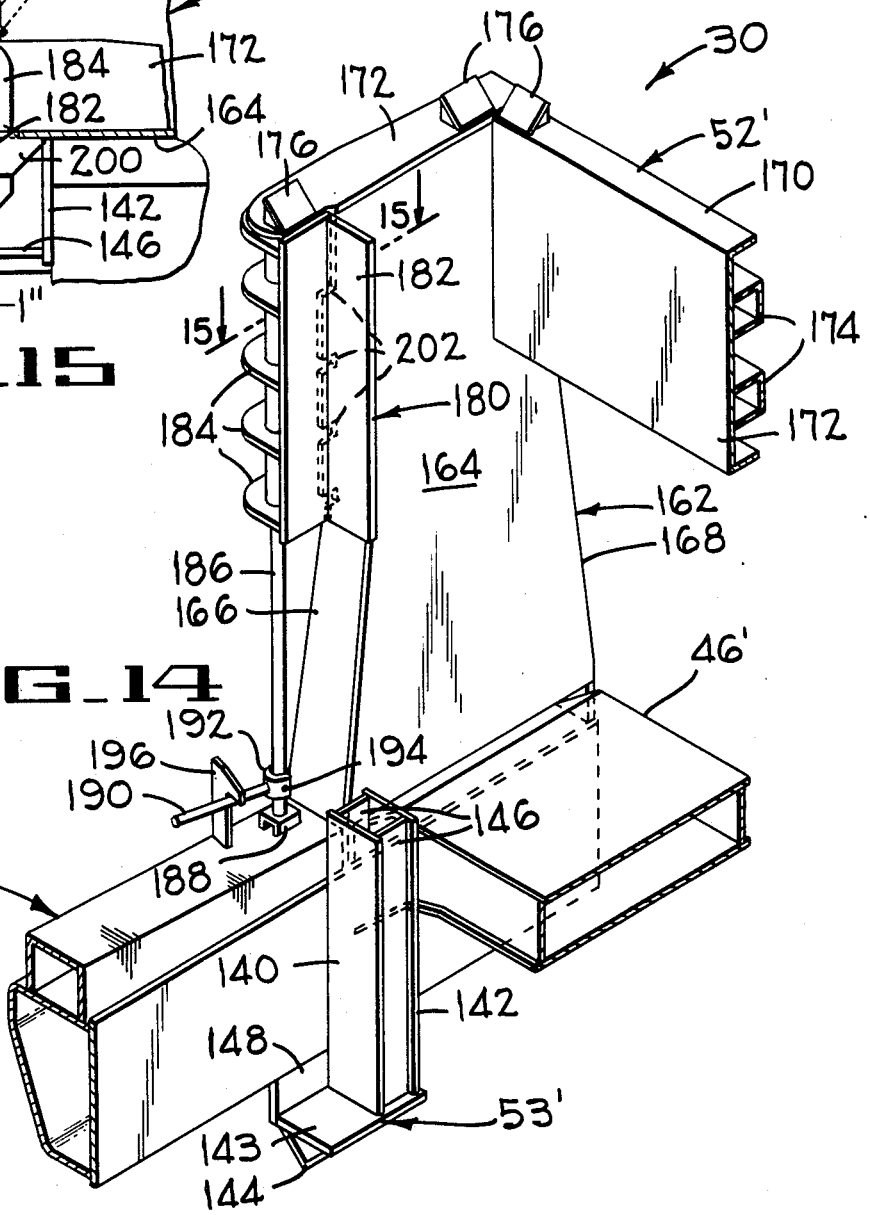
FIG_14

STACK SUPPORTING CONTAINER CAR

BACKGROUND OF THE INVENTION

Field of the Invention

The present invention pertains to railway cars and more particularly relates to light weight railway cars each including a plurality of articulated car units coupled to end car units with each car unit capable of carrying a stack of containers.

Due to the increased cost of locomotive fuel and the increased use of large shipping containers for transporting commodities long distances by rail, container supporting flat cars and some articulating cars are now being used by railroads. Heretofore most cars could not carry a stack of containers because low bridges along their routes would not provide adequate clearance for a stack of containers. The stack supporting container car of the present invention can be designed to handle many common container sizes such as: 40' long×9'-6" high; 45' long×9'-6" high; and 40' long×8' high. All containers are about 8 feet in width and when loaded may weight about 40,000–70,000 pounds.

SUMMARY OF THE INVENTION

The stack supporting container car of the present invention preferably includes five container supporting car units in each car with the intermediate units coupled together by articulated connectors, and with the end units capable of being coupled to a locomotive or to other standard railway cars such as freight cars, a caboose, and other stack supporting containers cars having standard railroad couplers. Each unit is capable of supporting a lower container of predetermined length, preferably 40 feet which will be termed a short container hereinafter, and a second container stacked on the lower container. The second container may be of the same Cpredetermined length as the short container or may be of a different predetermined length such as 45 feet which will hereinafter be termed a long container. In order to minimize the height of the upper surface of the uppermost container on each unit thereby permitting the car to pass below railroad bridges or the like, the lower portion of the lower container of the body of the associated car unit with the bottom of the lowermost container positioned at substantially 11½" above the top of the tracks. The corners of the bottom of the lower container are supported on container supporting feet connected to the body of the unit. The container restraining surfaces are arranged so that normal longitudinal acceleration and deceleration forces acting on the containers are transmitted down to the side sills and bolsters unless the force acting on the upper container is sufficient to cause the upper container to slide relative to the lower container and contact certain ones of the bulkhead supported restraining surfaces. End bulkheads of each unit includes end walls, side walls and movable corner guide mechanism which serve to restrain transverse and longitudinal movement of the upper of two 40 foot containers in a unit or the upper 45 foot container in a car unit.

BRIEF DESCRIPTION OF THE DRAWINGS

FIG. 11 is a top plan of one of the articulating connectors in relation to a truck, side bearings, and container supporting feet; the body bolsters being shown in phantom.

FIG. 12 is a section taken along lines 12—12 of FIG. 11.

FIG. 13 is an end elevation of a portion of the outer body bolster of FIG. 3 shown connected to fragments of an end sill and a stub center sill.

FIG. 14 is a perspective of a corner of an intermediate car unit illustrating the relative positions of a side sill, bolster, container supporting foot, and a movable corner engaging mechanism.

FIG. 15 is a section taken along lines 15—15 of FIG. 14 illustrating the corner engaging mechanism in two operative positions.

DESCRIPTIONS OF THE PREFERRED EMBODIMENT

Figure 1:
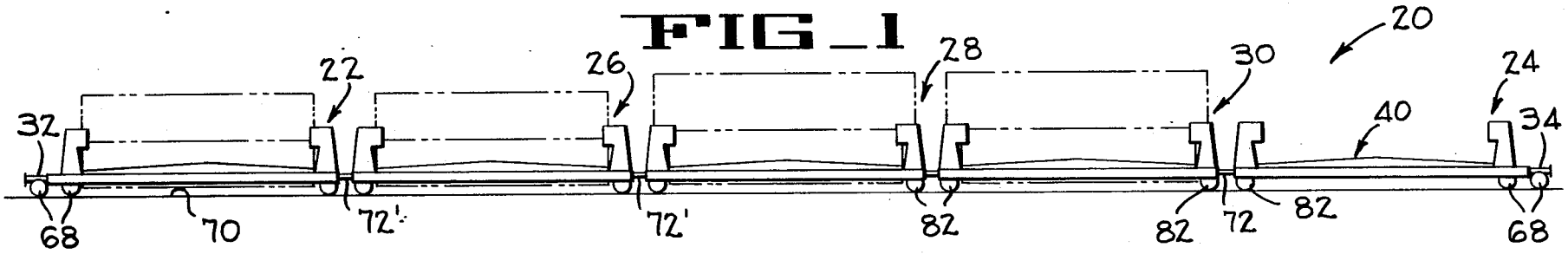
FIG. 1 is a diagrammatic side elevation of a five unit articulated car with one unit being empty and the other units having the outlines of a lower 40' container and a 40' or 45' upper container illustrated in phantom, certain of the containers being 9' 6" tall and others being 8 feet tall.

The stack supporting container car 20 (FIG. 1) of the present invention is illustrated as including two end car units 22, 24 and three intermediate car units 26, 28 and 30. The end units 22, 24 each include standard automatic coupler halves 32 and 34, respectively, thereby permitting the cars 20 to be coupled between standard railroad equipment such as locomotives, a caboose, box cars and other container cars 20. Although the preferred number of container supporting car units in a car 20 have been illustrated and will be described as being five units, it will be understood that more or less units may be combined to form a multiunit stack supporting container car.

Figure 4:
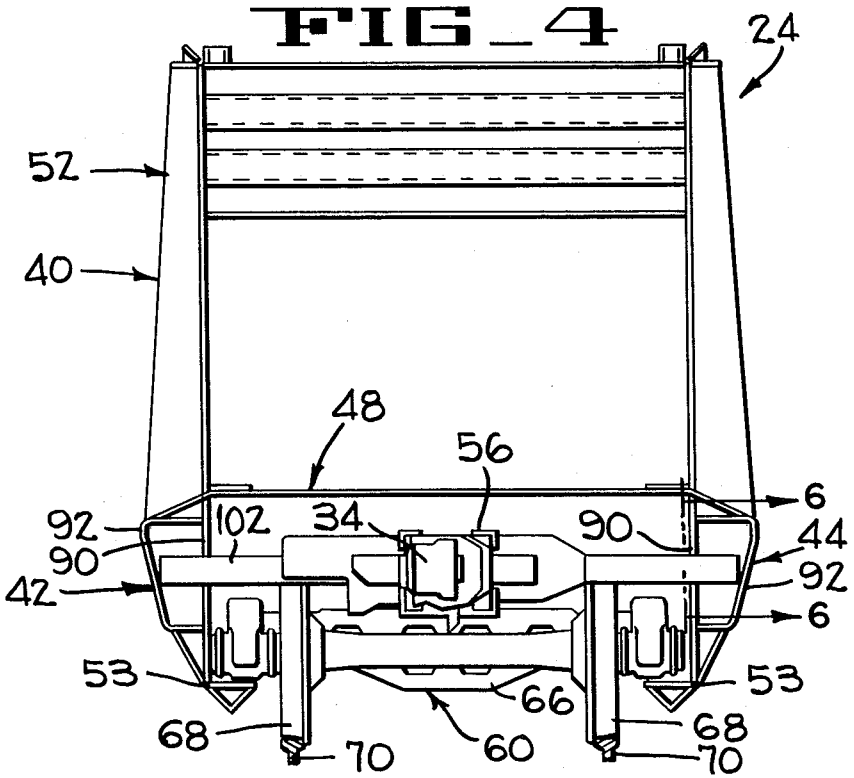
FIG. 4 is an end elevation looking in the direction of arrows 4—4 of FIG. 2.
Figure 5:
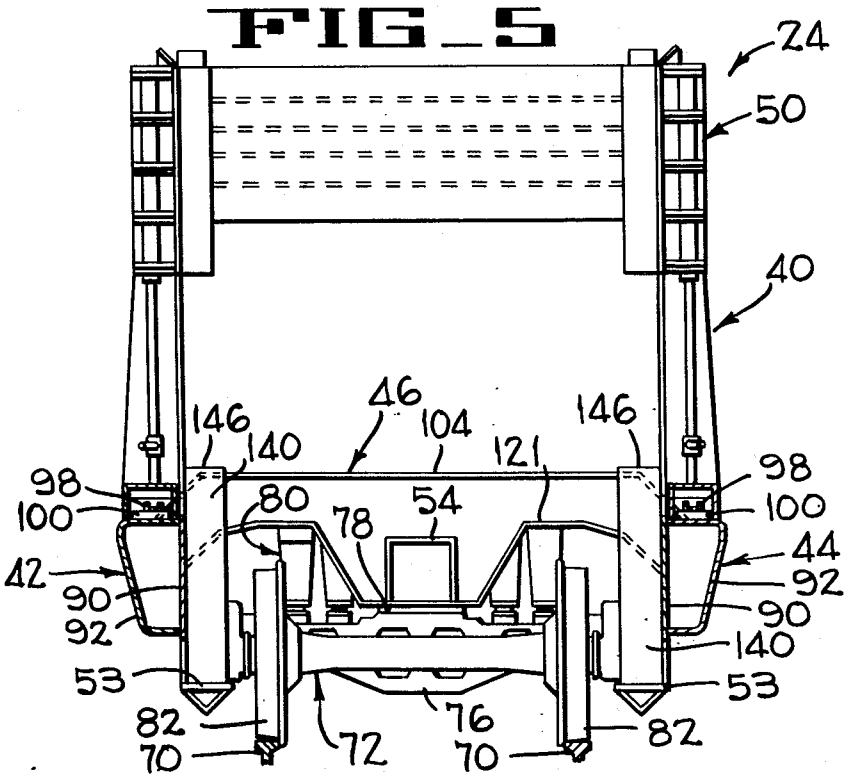
FIG. 5 is a section taken along lines 5—5 of FIG. 2.
Figure 7:
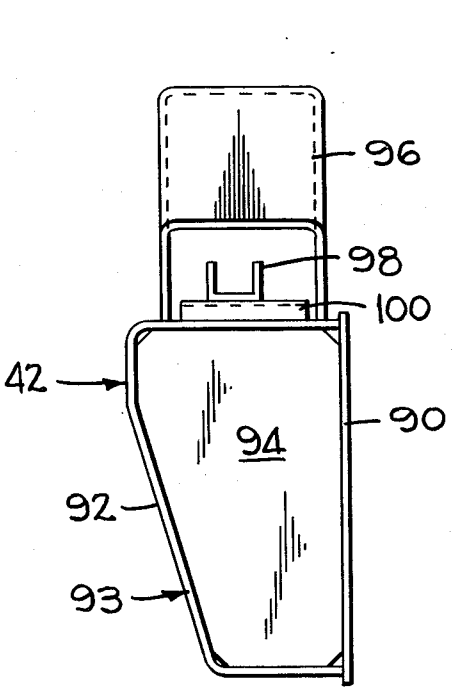
FIG. 7 is an end elevation of the side sill looking in the direction of arrows 7—7 of FIG. 6.

Having reference to FIGS. 2–7, the end car 24 comprises a body 40 which includes side sills 42, 44 welded to body bolsters 46, 48. The car also includes end bulkheads 50, 52 and four corner supporting feet 53 which provide sole support for the weight of the containers in each car unit and transmit this weight to the body of the car unit. The body 40 includes stub center sills 54 (FIG. 5) and 56 (FIG. 4). The center sill 56 is supported on a conventional four wheel truck 60 by a conventional center bearing (not shown) and conventional side bearing assemblies (not shown) disposed between the body bolster 48 and a truck bolster 66 of the truck 60. The wheels 68 of the truck 60 ride along tracks 70. The trucks 60 on each end of the five unit car 20 are preferably standard 70 ton trucks with 33 inch wheels. An intermediate truck 72 (FIG. 5) is disposed between the other end of the end car 24 and the next adjacent intermediate car 30. An articulating coupler 74 (FIGS. 2 and 11) is connected to the stub center sill 54 of the end car 24 and a similar stub center sill 54' of the next adjacent car. The articulating coupler 74 is connected to the truck bolster 76 (FIGS. 5 and 11) of the truck 72 by a center bearing 78, and side bearing assemblies 80. The intermediate truck 72 and all other intermediate trucks 72' (FIG. 1) are preferably 100 ton trucks with 36" wheels 82.

Figure 2:
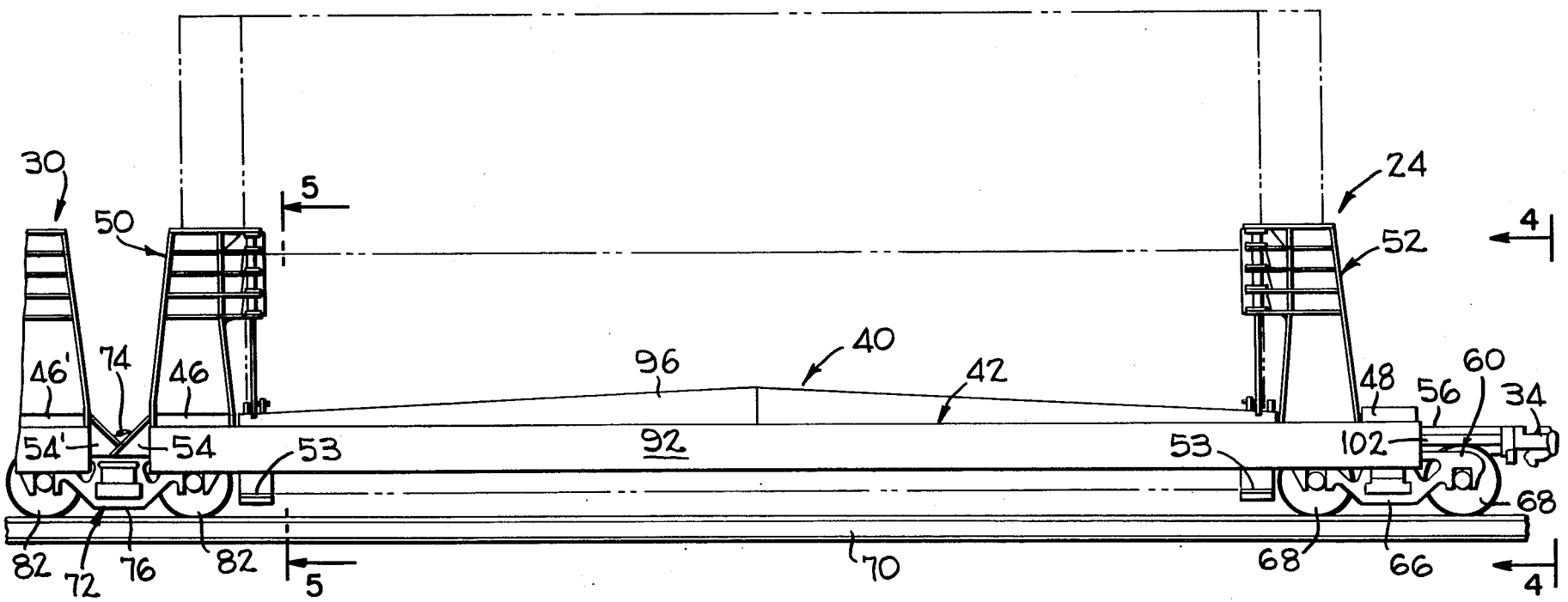
FIG. 2 is an enlarged side elevation of one of the end car units and a portion of an intermediate car unit; and further illustrating the positions of a lower 40' container and upper containers of 40 and 45 feet in phantom lines.
Figure 3:
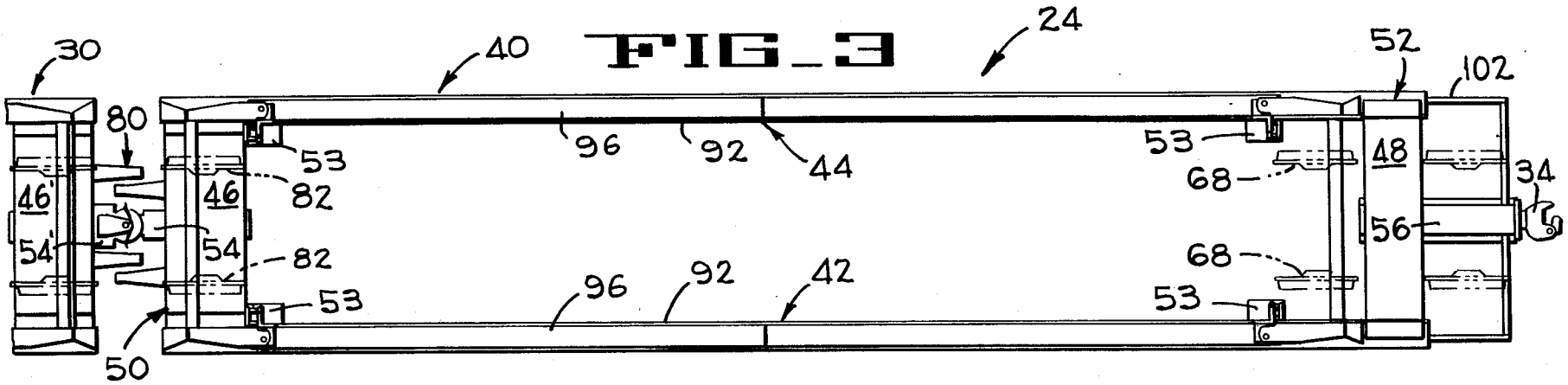
FIG. 3 is a top plan of FIG. 2.

As best shown in FIG. 2, the outer body bolster 48 is disposed above the center of the end truck 60, while the center of the intermediate truck 72 is disposed between car units 24 and 30 with the wheels 82 being positioned directly under the associated body bolsters 46, 46'. Thus, the overall length of each of the intermediate cars 26, 28 and 30 is shorter than the overall length of the end cars. In the illustrated embodiment of the present invention, the length of each end car unit is about 56'-4", and the length of each intermediate car unit is about 50'-4".

The side sills 42, 44 of the end car 24 are mirror images of each other and are about three feet longer than the side sills of the intermediate cars 26, 28 and 30. Each side sill 42, 44 comprises an elongated inner side plate 90 (FIGS. 6 and 7) welded to an elongated generally C-shaped outer wall 92 to define a tubular beam 93 of trapezoidal cross-section. End and intermediate gusset plates 94 are welded within the end portions of the tubular beam to strengthen the beam 93. In order to increase the beam strength of the tubular beam, an open ended, inverted channel member 96 of shallow V-shape in side elevation is welded to the top of the tubular beam. Channel guides 98 and U-shaped guides 100 are welded to the top of the beam 93 within the member 96 and act to serve as guides for conventional brake lines and the like (not shown) which pass through the channel members 96 on the several car units.

The outer ends of the side sills 42, 44 (FIGS. 3 and 4) are welded to the body bolsters 46, 48, and a platform 102 is provided on the outer end of body bolster 48. The body bolster 46 (FIGS. 3 and 13) comprises an upper wall 104 which is curved downwardly at the end portions and is welded to parallel end walls 106 (only one being shown). A lower sinuous wall 108 is also welded to the end wall 106 and has upturned curved portions 110. The upper and lower walls 104, 108 are wider than the two end walls and have external strengthening gussets 112 welded thereto and to the end walls 106. The gussets 112 are angled upwardly and inwardly from the curved portions 110 and cooperate with tubular brake line guides 114 and an inverted channel 116 to strengthen the body bolster 46. End pockets 118 (only one being shown) are provided with an upper and a side wall which are welded to the associated side sills 42, 44; and an inverted U-shaped pocket 120 receives and is welded to the stub center center sill 56.

The body bolster 46 (FIG. 5) on the inner end of the end car 24 (and on both ends of the intermediate cars 26, 28, 30) is disposed directly above the wheels 82 and accordingly the lower wall 121 is arched over the wheels. In other respect the body bolster 46 is similar to the end sill 48.

Most components of the intermediate car units 26, 28 and 30 (FIG. 1) are identical to the end units 22 and 24; and the car units 26 and 28 are identical to the intermeidate car unit 30. Accordingly, only the details of the intermediate car 30 which differ from those of the end car 24 will be described in detail and components of the intermediate car unit 30 which are substantially the same as those of the end unit 24 will be assigned the same numerals followed by a prime (').

The side sills 42', 44' of the intermediate car unit 30 are approximately 2½ feet shorter than those of the side sills of the end car units 24.

The side bearing assemblies 80 for the truck 72, and the trucks for all other intermediate car units 26, 28, 30 (FIG. 1) are illustrated in FIGS. 11 and 12 between the end car unit 24 and the intermediate car unit 30. The side bearing assembly 80 includes four side bearings 130 rigidly secured to the truck bolster 76. Two downwardly extending arms 132, 134 are welded to the body bolster 46 and have bearing plates 136 disposed in bearing engaging positions over associated side bearings 130. Similarly, two side bearing arms 132', 134' are welded to the body bolster 46' of car unit 30 and have bearing plates 136' disposed in bearing engaging positions over other side bearings 130. As illustrated in FIG. 11, the longitudinal midpoint between the arms 132, 134 are on one side of the central longitudinal axis of the cars 30, 24; and the longitudinal midpoint between the arms 132', 134' are on the other side of said central longitudinal axis. The side bearing assembly serves to minimize swaying of the cars when moving over uneven tracks and around curves.

An important feature of the invention is that the lowermost portion of the lower container in each car unit passes between the side sills 42, 44 (FIG. 3) and the body bolsters 46, 48 which cooperate to restrain longitudinal and transverse movement of the containers relative to the car body 40. The car body is devoid of any type of floor, cross braces or the like below the container and relies solely on four corner container supporting feet 53' (FIG. 14) for supporting the weight of the two containers in the car unit thus relying on the strength of the bottom of the container for supporting the weight of the articles therein.

Each container corner supporting foot 53' (FIGS. 14 and 15) of the intermediate car 30 comprises a pair of vertical plates 140, 142; a horizontal container supporting plate 143 reinforced by an angle member 144; a pair of spacers 146 between the vertical plates 140, 142; and a wall 148 between the plate 143 and the associated side sill 44'. All of the above components of the foot 53' are welded together and to at least the associated side sill. The four feet 53' of each unit provide sole vertical support for the container or containers in the associated car unit. The transverse inner walls of the plates 140 and the inner side walls of the side sills 42', 44' provide adequate clearance to receive the lowermost portion of the lower container therein and serve to restrain the container from transverse and longitudinal movement relative to its supporting car unit. In order to compensate for tolerance variations in the car body, shims may be welded to the container engaging face of member 140. If the car unit 30 is abruptly accelerated or decelerated with sufficient force to cause the lower container to aplly an impact force against a pair of vertical plates 140, it will be apparent that the impact force will be applied directly to both side sills 42', 44' and to the associated body bolster 46' or 48' because of the spacers 146 in intermediate car units 26, 28 and 30.

Another important feature of the invention is the provision of a relatively light weight bulkhead 50 and 52 on the ends of each car unit. All bulkheads 50, 52 are substantially the same, and accordingly only one of the bulkheads on the intermediate car 30 will be described in detail.

Figure 9:
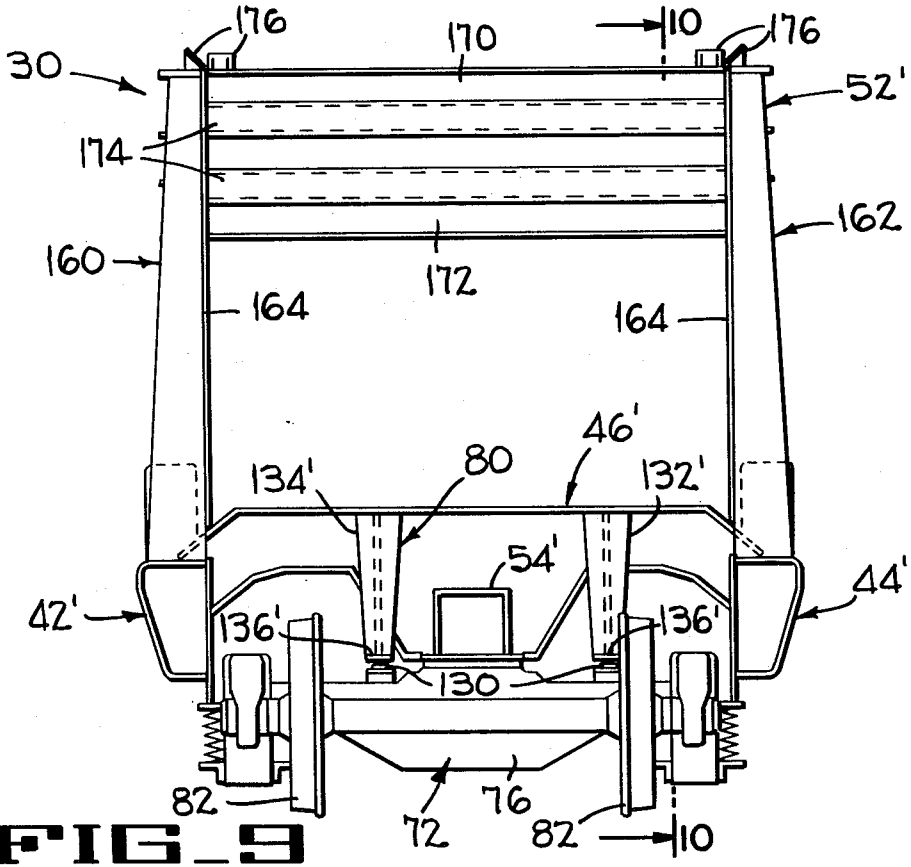
FIG. 9 is an end view of one of the intermediate car units, with the articulating connector being removed, for illustrating the bolster and offset side bearing supports relative to the longitudinal center line of the unit.
Figure 6:
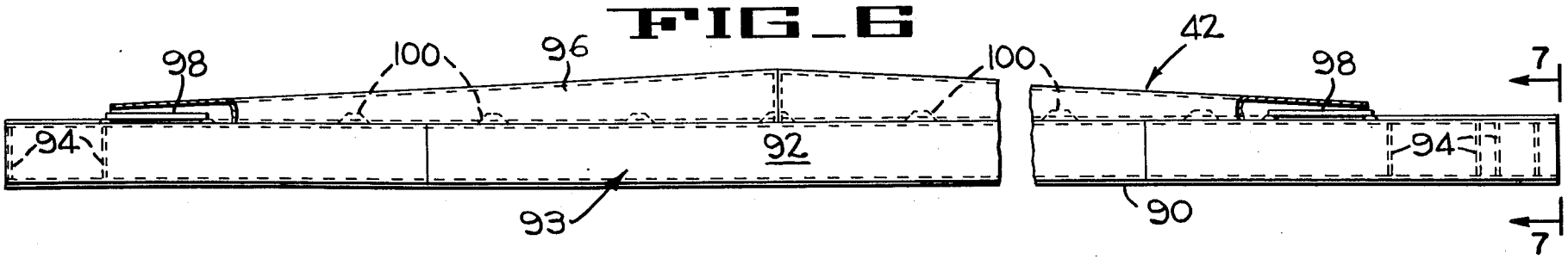
FIG. 6 is a side elevation of one of the side sills of the end unit of the car taken along lines 6—6 of FIG. 4.

The bulkhead 52' (FIGS. 9, 14 and 15) comprises a pair of upstanding container restraining side walls 160, 162 (FIGS. 8–10) each having an upright inner container restraining surface 164 and a pair of transferse webs 166, 168 (FIG. 14) projecting outwardly of the car unit. A transverse end wall 170 is formed from a wide channel 172 defining an end restraining wall which is reinforced by small channels 174. The end wall 170 is welded to the associated side walls 160, 162 and defines a container restraining wall for preventing excessive longitudinal movement of the long 45 foot containers. The side walls 160, 162 restrain transverse movement of the long 45 foot containers, and are welded to the associated side sills 42', 44' and to the body bolsters 46', 48'.

Figures 8, 10:
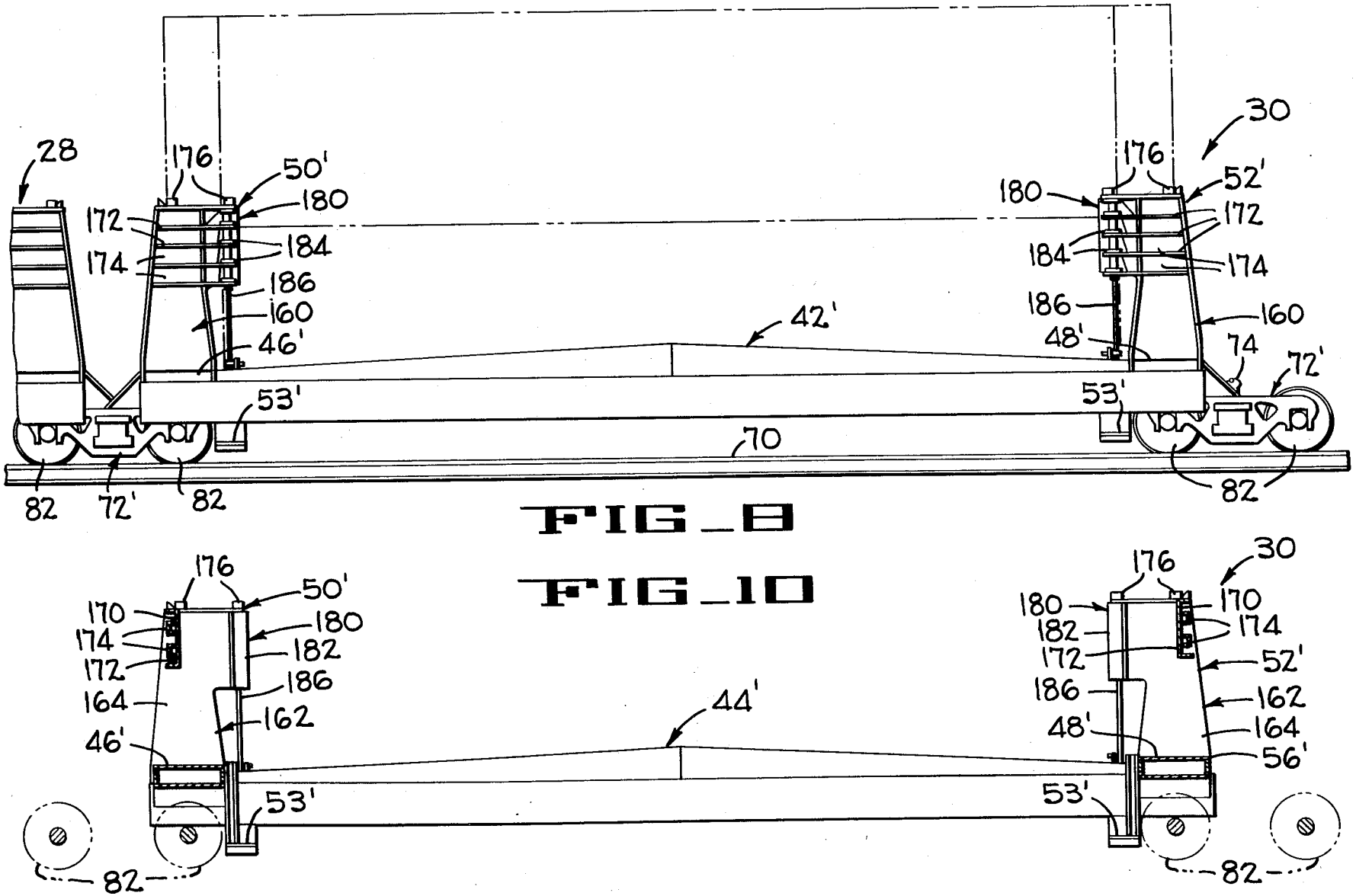
FIG. 8 is a side elevation of an intermediate car unit shown disconnected from other car units and illustrating the position of two 40 foot containers and one 45 foot container in phantom lines.
FIG. 10 is a section taken along lines 10—10 of FIG. 9 illustrating the body of an intermediate car unit, portions of the trucks being shown in phantom.

The upper portions of the side walls 160, 162 are each strengthened by five horizontal plates 172 and are further reinforced by vertical plates 174 as best illustrated in FIG. 8. Angle guides 176 are welded to the upper surfaces of the side walls 160, 162 and the transverse wall 170 for guiding the containers into the associated car units. Thus, the above described bulkhead components define fixed longitudinal and transverse bulkhead walls for restraining the long containers therein.

In order to restrain the short (40 foot containers) in the associated car unit 30, a pair of movable corner engaging mechanisms 180 are movably mounted on each bulkhead of all car units 22, 24, 26, 28 and 30.

Each movable corner engaging mechanism 180 (FIGS. 14 and 15) comprises an angle member 182 disposed in position to restrain both longitudinal and transverse movement of short (40 foot) upper container when in the operative position illustrated in FIG. 14. The angle member 182 is welded to a plurality of hinge members 184 which are secured to a vertical shaft 186 as by keys and set screws or the like. The shaft 186 is journaled in holes in the bulkhead plates 172 and in a bracket 188 secured to associated side sills, such as sills 44' (FIG. 14). A handle 190 is pivotally connected to the shaft 186 by a yoke 192 and pin 194. The handle is maintained in operative position shown in solid lines in FIGS. 14 and 15 by a latch hook 196 secured to the associated side sill. As shown in FIG. 15, a second latch hook 198 is secured to the associated side sill and engages the handle 190 to lock the corner engaging mechanism 180 in the inoperative position shown in phantom lines in FIG. 15. It is apparent that the handle may be pivoted upwardly above each latch hook 196, 198 in order to move the handle between its two latching positions.

As shown in FIG. 15 each hinge member 184 (except the upper member) is disposed above the associated plate 172 and is provided with a stop finger 200 which engages the associated side wall 164 to maintain the angle member 182 in an operative position. Slots 202 (FIG. 14) in the wall 164 permit portions of the hinge member 184 to pass therethrough and the angle member to swing into operative position.

Having reference to FIG. 15, it will be noted that the vertical planes of the container restraining surfaces 140 of the container engaging foot 53 is about one inch inward (relative to the container) as compared to the vertical plane of the container restraining surfaces of the transverse legs of the cooperating angle members 182. Thus, when two 40 foot containers are loaded into the car, and the four movable corner engaging mechanisms 180 are in their operative positions as illustrated in solid lines in FIGS. 14 and 15, the upper container must be subjected to abnormally large accelerating or decelerating forces which are sufficient to cause the upper containers to slide on the lower containers before the upper container will contact the angle members 182 with a substantial force. It will be understood, however, that the upper container may gradually creep to a position resting lightly against certain restraining surfaces but that an abnormally large accelerating or decelerating force will be required to subject the restraining surfaces to a substantial force. If such abnormal forces occur and the upper container engages the transverse legs of the associated pair of angle members 182, it will be apparent that the angle members will pivot slightly so that the longitudinal legs of the angle members will engage side portions of the upper and lower containers which prevents further pivotal movement of the angle members. Thus, all normal longitudinal accelerating and decelerating forces acting on the two containers in the car units are transmitted directly to the side sills and bolsters through the feet except for minor forces which may be applied to components of the bulkheads. Accordingly, the bulkheads and components thereon are relatively light in weight.

In operation, short containers are lowered onto the four feet 53' of the car units 22, 24, 26, 28 and 30 (FIG. 1) by conventional means (not shown); and either short or long (45 foot) containers are lowered onto the short containers. If an upper container is a 40 foot container, four associated movable corner engaging mechanisms 180 are extended into their operative restraining positions illustrated in FIG. 14 by means of the handle 190. If an upper container is a long container, the handles 190 of the four mechanism 180 are moved to the dotted line position (FIG. 15) thus retracting the corner engaging mechanism from the fixed restraining walls of the associated bulkheads 52'. The long container is then lowered upon the short container in the car unit. With the car units loaded as above described, the car 20 is connected in a train that includes a locomotive and may include other types of cars. Since the bottom of the lower containers are about 11½ inches above the top of the rails, the top of the uppermost container will have ample clearance to move below railroad bridges or the like.

From the foregoing description it is apparent that the double stack container car of the present invention is a light weight car that includes several car units, preferably five units, with the end units capable of being coupled to standard railway equipment. Each car unit is capable of supporting a short lower container and either a short or long upper container. The weight of the containers in a car unit is supported only by four corner feet connected to the side sills and the bottom of the lower container projects downwardly below and is restrained within the side sill and body bolsters. Bulkheads on each end of each car unit include fixed restraining surfaces for restraining the long containers and movable restraining members for restraining the short containers.

Although the best mode contemplated for carrying out the present invention has been herein shown and described, it will be apparent that modification and variation may be made without departing from what is regarded to be the subject matter of the invention.

I claim:

1. A stack supporting container railway car unit for selectively supporting upper and lower containers of the same length, or upper and lower containers with the upper container being longer than the lower container, each container having four upright corners defined by side and end walls, and also having top and bottom walls with the bottom of the lower container being spaced as close to the top of the railroad tracks as believed safe, comprising:

(a) first and second trucks having wheels adapted to be supported on railroad tracks;

(b) a first body bolster pivotally supported on said first truck;

(c) a second body bolster pivotally supported on said second truck;

(d) a pair of parallel side sills rigidly secured to said body bolsters, said body bolsters and said side sills defining an opening of sufficient size to permit the bottom of a lower container to pass therebetween;

(e) means defining corner supporting feet each including a generally horizontal container supporting surface and adapted to receive the corners of said lower container for solely supporting the weight of the containers and transmitting the weight to said side sills, said corner supporting feet including upstanding transverse surface means for assisting the side sills to restrain longitudinal and transverse movement of the lower container in said car unit;

(f) a first bulkhead rigidly secured to said first body bolster and to said side sills;

(g) a second bulkhead rigidly secured to at least said side sills;

(h) restraining means, included in each of said first and second bulkheads, including fixed longitudinal and transverse bulkhead walls positioned respectively on each bulkhead to restrain at least the lower portions of associated corners of the upper container, for maintaining an upper container in transport position upon a lower container within the railway car unit; and (i) a plurality of movable corner engaging mechanisms adapted to be moved to a container restraining position in which respective parts thereof extend transversely inward of respective ones of said longitudinal bulkhead walls to restrain longitudinal and lateral movement of the upper container when subjected to severe container dislodging forces, when both containers are of the same length, and said movable corner engaging mechanisms being adapted to be moved out of said container restraining position and said longitudinal and transverse bulkhead walls being effective to assist in restraining movement of the upper container while said corner supporting feet, assisted by said side sills and body bolsters, restain longitudinal and lateral movement of the lower containers when the upper container is longer than said lower container.

2. A railway car unit according to claim 1 wherein each of said corner supporting feet includes one of said upstanding transverse surface means and said upstanding transverse surface means is adapted for restraining longitudinal movement of the lower container relative to the car unit and for applying longitudinal forces due to acceleration or deceleration of the lower container through the side sills directly to the body bolster.

3. A railway car unit according to claim 2 wherein said corner engaging mechanisms include respective container engaging surfaces and said upstanding transverse surface means of each pair of said corner supporting feet are disposed about one inch inwardly of a transverse plane defined by said container engaging surfaces of the adjacent pair of corner engaging mechanisms, thereby requiring that longitudinal acceleration or deceleration forces acting on the upper container be sufficient to cause the upper container to slide longitudinally on the lower container before said upper container can apply a substantial longitudinal force on said bulkheads.

* * * * *

UNITED STATES PATENT AND TRADEMARK OFFICE

CERTIFICATE OF CORRECTION

PATENT NO. : 4,624,188

DATED : November 25, 1986

INVENTOR(S) : Gary S. Kaleta

It is certified that error appears in the above-identified patent and that said Letters Patent is hereby corrected as shown below:

Title page:

In the Abstract, line 2, change "connector" to --connectors--.

| | | | |
|---|---|---|---|
| Col. 1, | Line 24 | Change "weight" to --weigh--; |
| | Line 39 | Change "Cpredetermined" to --predetermined--; |
| | Line 45 | After "container" insert --projects downwardly between side sills and bolsters--; |
| | Line 59 | Change "mechanism" to --mechanisms--. |
| Col. 2, | Line 42 | Change "DESCRIPTIONS" to --DESCRIPTION--. |
| Col. 4, | Line 3 | Change "intermeidate" to --intermediate--; |
| | Line 65 | Change "aplly" to --apply--. |
| Col. 6, | Line 40 | Change "mechanism" to --mechanisms--. |

Signed and Sealed this

Ninth Day of February, 1988

*Attest:*

DONALD J. QUIGG

*Attesting Officer*

*Commissioner of Patents and Trademarks*